US005308224A

United States Patent [19]

Olivero et al.

[11] Patent Number: 5,308,224

[45] Date of Patent: May 3, 1994

[54] ANTIVIBRATION SUSPENSION DEVICE FOR A BLOWER

[75] Inventors: Michele Olivero, Volpiano; Renato Bortolin, Montanaro, both of Italy

[73] Assignee: Olivetti-Canon Industriale S.p.A., Ivrea, Italy

[21] Appl. No.: 14,511

[22] Filed: Feb. 8, 1993

[30] Foreign Application Priority Data

Feb. 10, 1992 [IT] Italy ..... TO92A00 0100

[51] Int. Cl.[5] ..... F04D 29/66

[52] U.S. Cl. ..... 415/53.1; 415/119; 415/213.1; 417/363

[58] Field of Search ..... 415/119, 213.1, 53.1, 415/53.2, 53.3; 417/363

[56] References Cited

U.S. PATENT DOCUMENTS

| | | | |
|---|---|---|---|
| 2,028,985 | 1/1936 | Mahon | 415/119 |
| 2,772,047 | 11/1956 | Sonnberger | 417/363 |
| 2,823,598 | 2/1958 | Jenn | 415/119 |
| 2,928,589 | 3/1960 | Davey | 417/363 |

FOREIGN PATENT DOCUMENTS

| | | | |
|---|---|---|---|
| 134269 | 6/1991 | Japan | 417/363 |
| 877618 | 9/1961 | United Kingdom | 415/119 |

*Primary Examiner*—Edward K. Look
*Assistant Examiner*—James A. Larson
*Attorney, Agent, or Firm*—Banner, Birch, McKie & Beckett

[57] ABSTRACT

In photocopying and/or printing machines, the blower or fan used for internal ventilation is suspended from the structure of the machine by springs slung between the blower casing and the machine structure to eliminate the transmission of vibrations to delicate members in the machine itself.

9 Claims, 2 Drawing Sheets

ANTIVIBRATION SUSPENSION DEVICE FOR A BLOWER

FIELD OF THE INVENTION

The present invention relates to an antivibration suspension device for a blower and more particularly a method of suspension for preventing the transmission of the vibrations of a rotor of an electric motor and of an impeller of the blower to the supporting structure.

BACKGROUND OF THE INVENTION

In machines such as photocopiers and laser printers it is necessary to create ventilation inside the machine to remove the heat generated by certain parts of the machines. For this purpose, fans or blowers are used. In these the impellers are often not correctly dynamically balanced, with the result that vibrations are generated which are harmful to good machine operation.

The prior art methods for damping these vibrations include the use of damping materials such as rings or cushion pads of special rubber placed between the blower and its supporting structure in order to reduce the transmission of vibrations.

Even though these prior art solutions are satisfactory, they require the construction of usually expensive special rubber parts, and the supporting structure has to be adapted to the shape and dimensions of the blower which it is designed to support.

SUMMARY OF THE INVENTION

Preferred embodiments of the present invention provide a suspension device for a blower which has a very simple, light structure and none of the drawbacks described above.

In a prefered embodiment of the invention the blower or fan used for internal ventilation of a photocopier or the like is suspended from the structure of the machine by means of springs slung between the blower casing and the machine structure. This eliminates the transmission of vibrations to delicate parts of the machine.

The invention is defined in the appended claims to which reference should now be made.

BRIEF DESCRIPTION OF THE DRAWINGS

A preferred embodiment of the invention will now be described in detail by way of example, with reference to the accompanying drawings, in which.

DETAILED DESCRIPTION OF A PREFERRED EMBODIMENT

Figure 1:
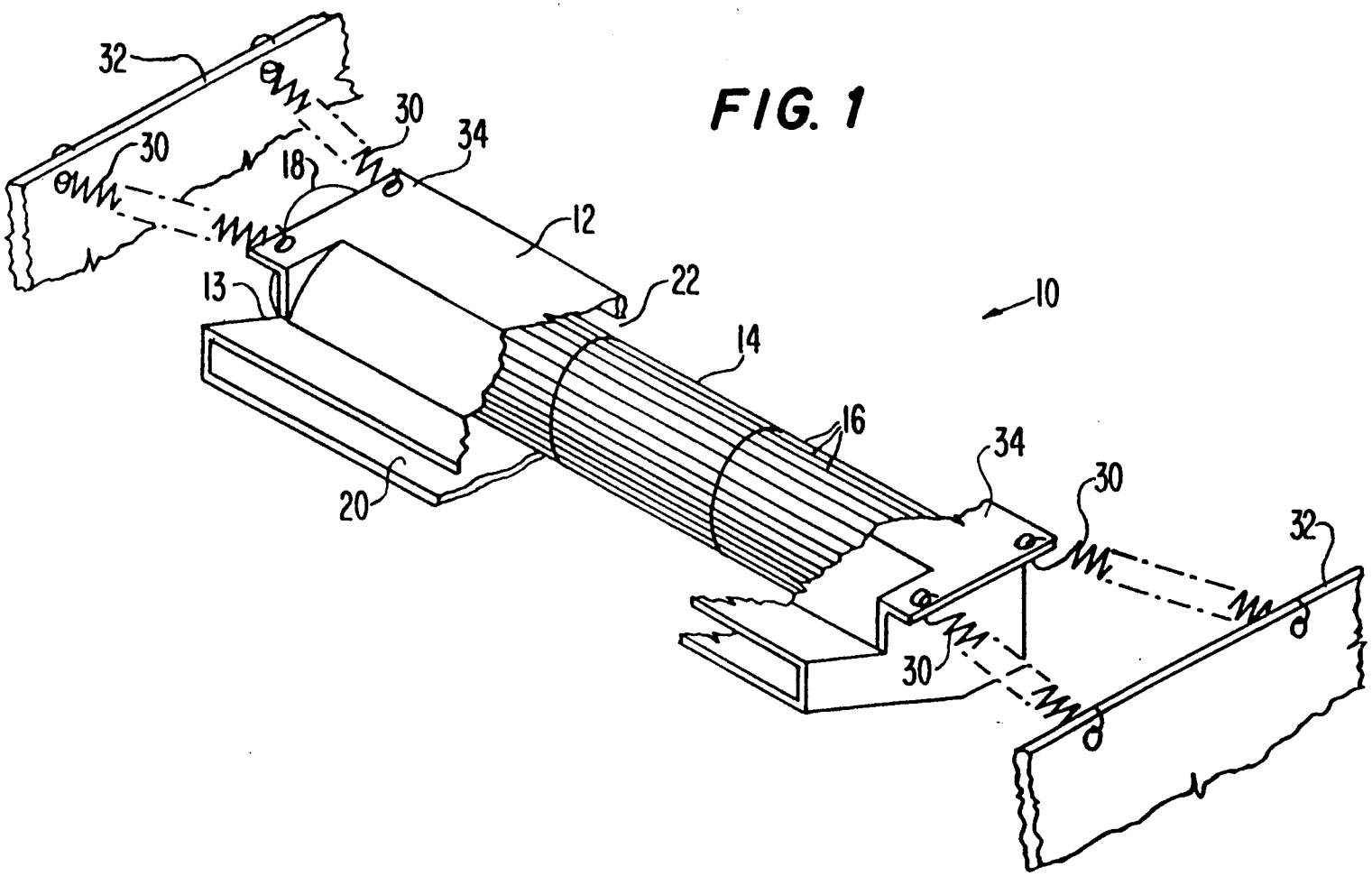
FIG. 1 is a perspective view of a suspension device embodying to the invention.
Figure 2:
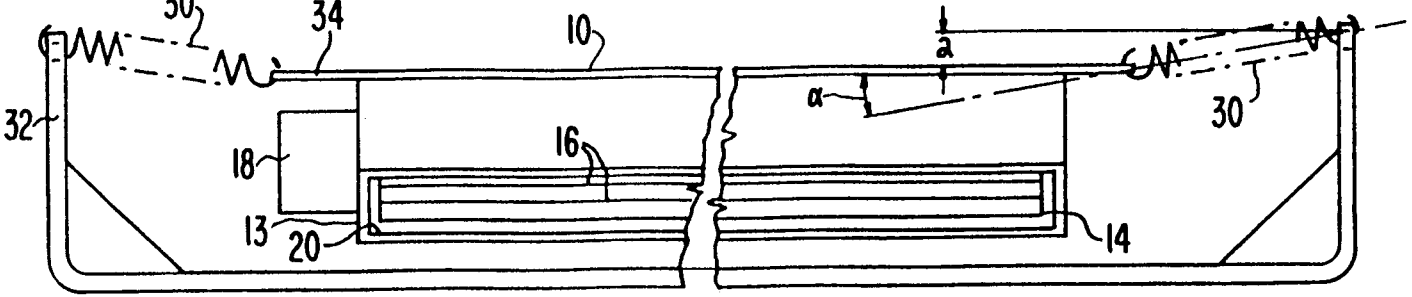
FIG. 2 is a diagrammatic front elevation of the suspension device of FIG. 1.
Figure 3:
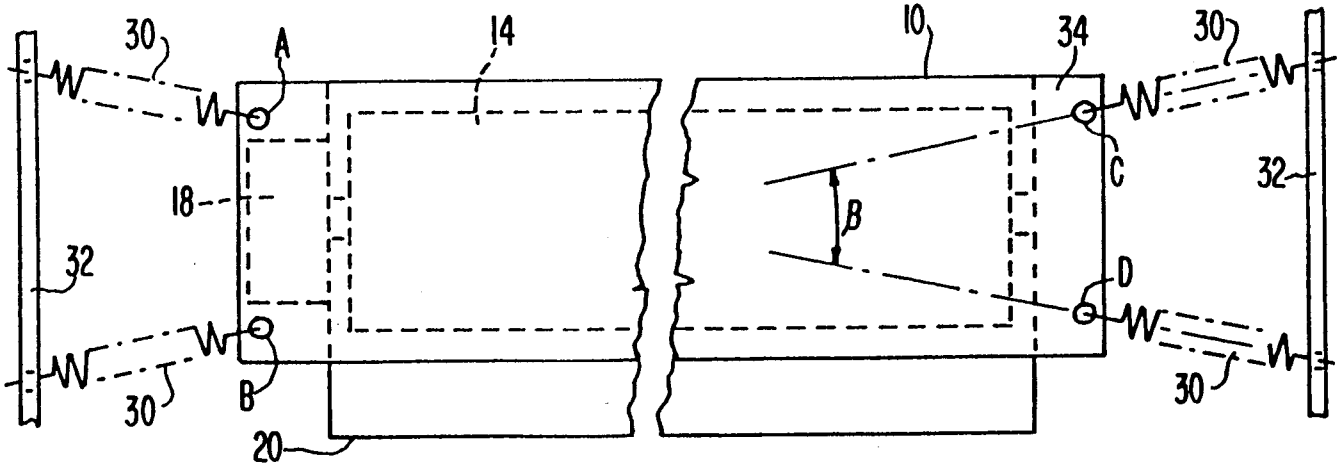
FIG. 3 is a diagrammatic plan view of the suspension device of FIG. 1.

With reference to FIGS. 1, 2 and 3, a blower 10 comprises a casing 12 on which there rotates an impeller 14 having blades 16 which lie in the axial direction.

The impeller 14 is turned by an electric motor 18 fixed to the casing 12, its rotor being connected directly to the shaft of the impeller.

The casing 12 is so shaped as to define an air outlet 20 and inlet 22.

The unit formed by the blower and its motor is used, for example, in a photocopying machine or in a laser printer to create internal ventilation in order to stabilise the temperature of working members of the machine.

During the rotation of the impeller of the blower and of the rotor of the motor, two main types of vibration are set up. The first type of vibrations are caused by variations in the speed of rotation of the impeller rotor unit due to irregularities in the torque provided by the motor and to irregularities in the resistance encountered by the impeller blades.

The second type of vibrations are caused by imperfections in the constructions either of the rotor, or of the impeller, with the result that imperfectly balanced eccentric masses cause vibrations in radial directions as they rotate.

Consequently the blower-motor unit may oscillate and transmit vibrations to the photocopier structure and disturb the correct operation of delicate and precise devices within the machine, such as the optical system or the image developing means.

To overcome this problem, the blower motor unit is suspended from the structure 24 of the machine by means of a system 28 of helical traction springs 30 slung between the casing 12 and a rigid frame 32 of the machine.

In the embodiment shown in the figures, four helical springs are used, two on each side. These are individually anchored at four points A, B, C, D respectively (FIG. 3) on a plate 34 forming part of the casing 12 lying parallel to the axis of the impeller 14; these points are situated at the vertices of a rectangle. The springs 30 may have identical mechanical characteristics or, in certain cases, different mechanical characteristics from each other.

To simplify the mounting and reduce costs, it is preferable to use identical springs. It may however be that the weight of the motor 18, which is fixed at one end 13 of the casing 12, is greater than the weight of the blower. The centre of gravity of the complete unit may therefore be in an asymmetric position, shifted towards the motor.

In this case it will be necessary to use two springs on the motor side whose stiffness is greater than that of the two springs mounted at the opposite end of the casing 12.

The stiffness and dimensions of the springs are so determined that the motor-blower unit is suspended in a position that is approximately near and parallel to the position which it would adopt if it were fixed rigidly to the frame 32. It has been found that the best position for the blower 10 to be suspended, in order to reduce transmissions of vibrations to a minimum, is that in which those ends of the springs that are fixed to the blower are at a lower level than the ends fixed to the frame 32 by a distance "a" (FIG. 2) which is not more than 7 mm.

In corresponding fashion the two pairs of springs arrange themselves symmetrically with their axes inclined in a vertical plane by an angle $\alpha$ of between 5° and 15° with respect to a horizontal straight line. It is preferable for the angle $\alpha$ to be approximately 10°.

Moreover, to compensate for the radial component of the vibrations of the motor-blower unit in a horizontal plane, the springs of each pair are slung divergent fashion so as to form an angle $\beta$ with each other of between 10° and 30° (FIG. 3).

In general, let P be the total weight of the blower 10 and motor 18, n the number of springs used to support the unit, and $\alpha$ and $\beta$ the angles defined above. Then the load C which each spring must support when in use is given by the equation:

$$C=KP/n,$$

in which K is a number between 4 and 11.5 that corresponds to the reciprocal of the product $\sin \alpha \cos \beta/2$.

Each of the springs should preferably be preloaded with a load of between 15% and 25% of the maximum load to which it is subjected in the supporting position.

The extension $\delta L$ of the spring under maximum load is designed as appropriate to be between 35% and 45% of the initial length of the spring in the unloaded state.

Measurements have been made of the maximum amplitude of the vibrations transmitted to the lens of a photocopier, using one example of a blower mounted in two different ways:

in case A, the blower is mounted in the conventional way with interposed rubber blocks, while in case B the blower, of total weight P=500 g, is suspended as shown in the figures, with four identical springs having the following characteristics:

| | |
|---|---|
| Spring diameter | 6 mm |
| Wire diameter | 0.65 mm |
| Number of turns | 12 |
| Initial length | 14 mm |
| Extension $\delta L$ | 8 mm |
| Elastic characteristic Km | 83.2 g/mm |

In case A the vibrations transmitted to the lens from the blower have an amplitude of approximately 20 μm, while in case B the blower-motor unit is arranged in a position in which the springs form an angle α of approximately 10° and the vibrations of the lens are reduced to an amplitude of 0.4 μm, Or one fiftieth of that encountered in case A.

We claim:

1. An antivibration suspension device for a blower mounted on a rigid structure, said blower having a casing, an impeller with blades which rotates on said casing and a motor mounted on said casing so as to turn said impeller; having:

the suspension device comprising two sets of springs anchored by first ends of said springs to opposite sides of said casing and by opposite ends of said springs to fixed points on said rigid structure, wherein each of said springs is slung between said casing and said rigid structure with an extension $\delta L$ of between 35% and 45% of the initial length of said spring.

2. An antivibration suspension device according to claim 1, wherein each of said springs is so proportioned that when said blower is in a suspended position, said first end of said spring is at a lower level than said fixed end by a distance "a" which is not more than 7 mm.

3. An antivibration suspension device according to claim 2, wherein a longitudinal axis of each of said springs forms an angle α of between 5 and 15°, measured in a vertical plane relative to a horizontal straight line.

4. An antivibration suspension device according to claim 3, wherein said angle is 10°.

5. An antivibration suspension device according to claim 1 or 3, wherein each of said springs has dimensions such as to enable it to support a load C given by C=KP/n, in which P is total weight of said blower, n is total number springs and K is a positive number of between 4 and 11.5.

6. An antivibration suspension device according to claim 3, wherein each of said sets of springs comprises at least two springs forming an angle β with each other of between 10° and 30° measured in a horizontal plane.

7. Method for antivibration suspension of a blower on a rigid structure, said blower comprising a casing, an impeller having blades and a motor mounted on said casing so as to turn said impeller, the method comprising the following steps:

(a) fitting two sets of springs, by anchoring first ends of said springs to opposite sides of said casing, each spring having dimensions such as to enable it to support a working load C given by C=KP/n, in which P is total weight of said blower, n is number springs, and K is a positive number of between 4 and 11.5;

(b) slinging said springs between said casing and said rigid structure so as to bring about an extension $\delta L$ of each spring of between 35% and 45% of an initial length of said spring, (c) anchoring opposing ends of the springs of each set to fixed points on said rigid structure in such a way that at least two of said springs diverge by an angle β of between 10° and 30°, whereby said blower is suspended from said rigid structure in a relative position such that longitudinal axes of said springs of said sets form an angle α of between 5° and 15° relative to a horizontal straight line.

8. Method for antivibration suspension according to claim 7, wherein each of said sets referred in step a) comprises at least two springs.

9. Method for antivibration suspension according to claim 8, wherein said springs have identical mechanical and geometrical characteristics, and wherein said blower assumes a suspended position in which said first ends lie at a lower level than said fixed points by a distance "a" which is not more than 7 mm.

* * * * *